US006026512A

United States Patent [19]

Banks

[11] Patent Number: 6,026,512

[45] **Date of Patent: *Feb. 22, 2000**

[54] STATIC ELECTRICITY DISSIPATION GARMENT

[76] Inventor: David L. Banks, 7362 E. 87th St., Los Angeles, Calif. 90045

[ * ] Notice: This patent is subject to a terminal disclaimer.

[21] Appl. No.: 08/950,096

[22] Filed: Oct. 14, 1997

Related U.S. Application Data

[63] Continuation-in-part of application No. 08/777,167, Dec. 26, 1996, Pat. No. 5,715,536.

[51] Int. Cl.[7] ..... H05F 3/02; A41D 13/02

[52] U.S. Cl. ..... 2/69; 2/227; 2/79; 361/212; 361/220

[58] Field of Search ..... 2/69–79, 227; 438/256, 259, 381; 174/55 B, 5 R, 5 SG; 361/212, 220, 223, 224

[56] References Cited

U.S. PATENT DOCUMENTS

| | | | |
|---|---|---|---|
| 3,699,590 | 10/1972 | Webber et al. | 361/220 |
| 4,422,483 | 12/1983 | Zins | 139/420 R |
| 4,596,053 | 6/1986 | Cohen et al. | 361/220 |
| 5,440,444 | 8/1995 | Adams | 361/220 |
| 5,548,469 | 8/1996 | Adams | 361/220 |

*Primary Examiner*—John J. Calvert
*Assistant Examiner*—Shirra L. Jenkins
*Attorney, Agent, or Firm*—Jack C. Munro

[57] ABSTRACT

A static electricity dissipation garment where the body of the garment is constructed of fabric within which is woven strands of carbon. The body will be constructed as a smock or as a pant suit. The pant suit garment includes a pair of side seams located between the torso section of the garment and down each leg section of the garment. The smock includes a similar pair of side seams in the torso section. A first embodiment of the garment includes sleeve seams that extend along the entire length of each sleeve of the garment and then along the connection of the sleeve to the upper part of the torso section and then along the collar of the garment. Within each of these seams, along the entire length of the seam, is included an electrically conductive ribbon. The ribbon of the side seam is designed to overlap a substantial length of the sleeve seam. The ribbons of the two sleeve seams and side seams overlap each other in the area of the collar. An appropriate electrical connector is connected to the ribbon of at least one side seam. An electrical conductor is to be connected to the electrical connector which is to function to remove static electricity that accumulates on the garment. A second embodiment of garment has each side seam extending down each sleeve and terminates at the cuff. Transverse ribbons are mounted across the torso section of the first embodiment, second embodiment, smock and pant suit garment which provide a dual pair of electrical connectors each of which may be used to remove static electricity by being connected to an output electrical conducting grounding wire. Boots and gaiters could be manufactured to include similar electrically conductive ribbons and hence be dissipative of static electricity.

21 Claims, 7 Drawing Sheets

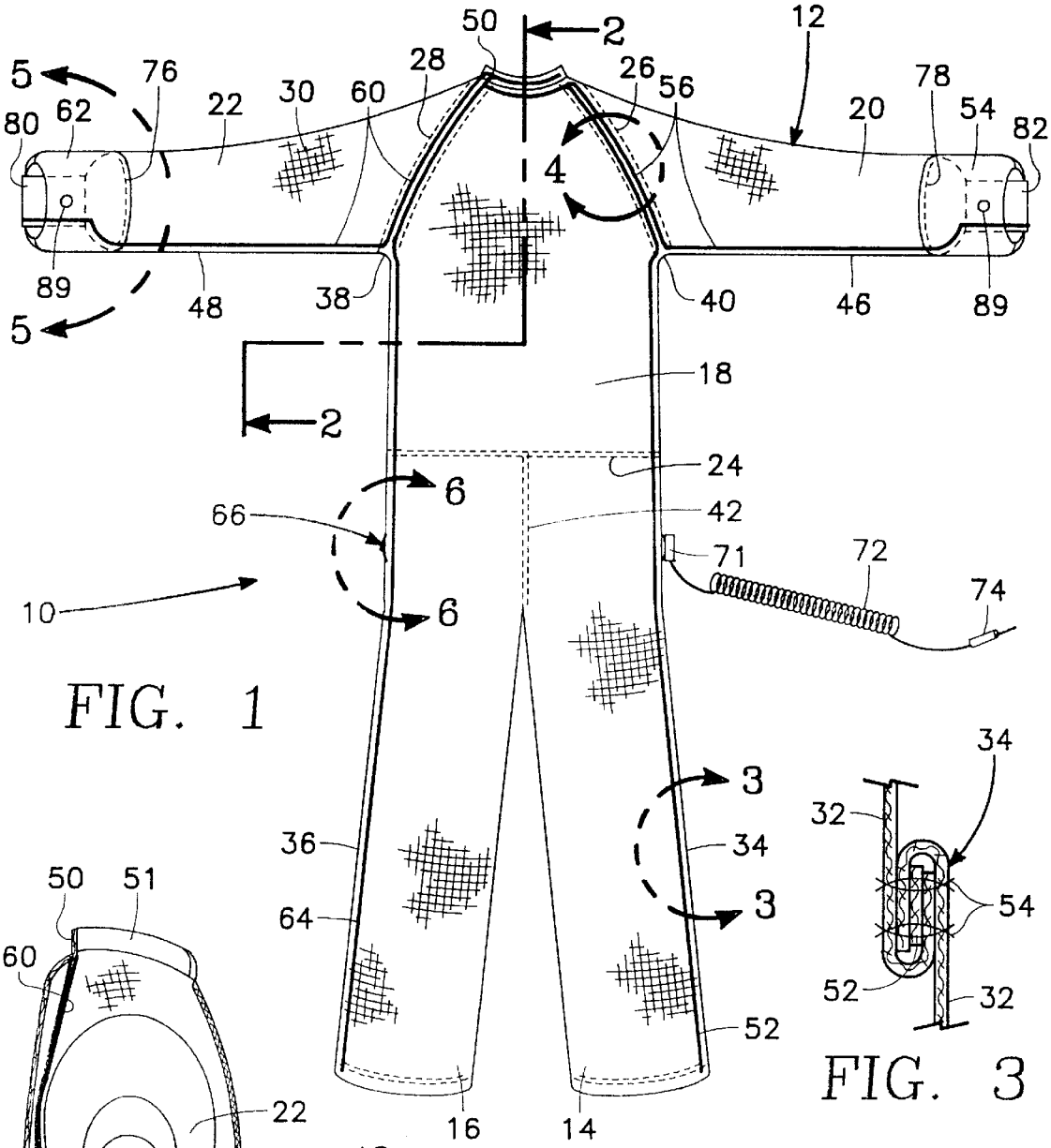
FIG. 1
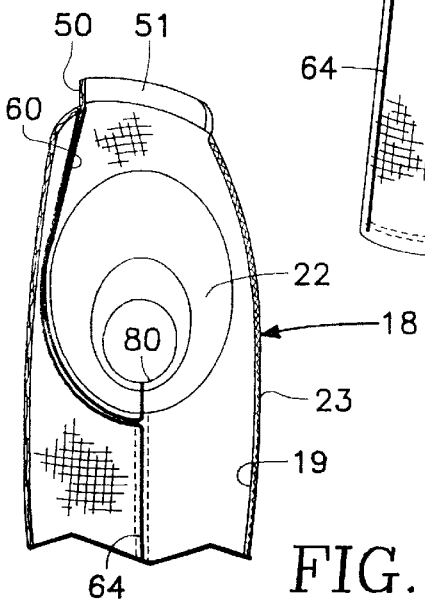
FIG. 2
FIG. 3
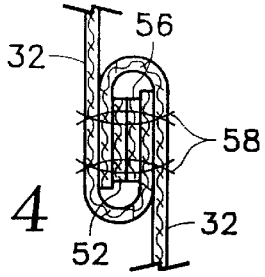
FIG. 4

STATIC ELECTRICITY DISSIPATION GARMENT

This application is a continuation-in-part of patent application entitled STATIC ELECTRICITY DISSIPATION GARMENT Ser. No. 08/777,167, filed Dec. 26, 1996, now U.S. Pat. No. 5,715,536, by the present inventor.

BACKGROUND OF THE INVENTION

1) Field of the Invention

The field of this invention relates to garments and more particularly to a garment that is designed primarily to minimize static electricity generated in a controlled environment (clean room).

2) Description of the Prior Art

During the manufacturing of certain equipment, there is a need for the workers involved to be as free as possible of static electricity. Typically, electronic equipment construction, such as disc drives, requires a near static-free environment. In the past, as long as the people involved in disc drive manufacturing generated less than a couple hundred volts of static electricity, the process was not adversely affected. Recently, however, disc drives having a higher degree of sensitivity are being created, and it has become mandatory that workers have less than twenty volts of static electricity on their person. This is an exceedingly small amount of static electricity, particularly in view of the fact that the mere act of moving an arm through the air would normally generate at least that amount of voltage.

SUMMARY OF THE INVENTION

The primary objective of the present invention is to construct a static electricity dissipation garment which will result in the person wearing the garment generating less than twenty volts of static electricity at any given time.

Another objective of the present invention is to construct a static electricity dissipation garment which is manufactured in a simple manner and therefore can be constructed inexpensively and ultimately sold at a relatively inexpensive price to the consumer.

The static elimination garment of the present invention is constructed of a one hundred percent polyester monofilament fabric material which is intended to be worn as an overgarment covering clothes worn by the user. The body of the garment is constructed of fabric, and within this fabric are weaved strands of carbon with these strands forming a crisscross pattern within the body of the garment. One version of the garment includes a pair of leg sections that is located in juxtaposition which is connected to the lower end of a torso section. From each side of the torso section is mounted a sleeve section with the two sleeve sections being mounted at the upper end of the torso section terminating in a neck opening which is surrounded by a collar. The garment includes a side seam at each side of the garment. The side seam extends the entire length of the leg section and about half the length of the torso section terminating in the underarm area directly adjacent a sleeve section. There is a sleeve seam that extends the entire length of each sleeve terminating at the outer end of the seam in the cuff area which is to be placed around the wrist of the user. The inner end of the sleeve seam is positioned at the connection between the torso section and the sleeve and terminates in the collar surrounding the neck opening. Sewn within each of the seams, and electrically connecting with the numerous cross strands of carbon fibers sewn into the body of the garment, are electrically conductive ribbons. The electrically conductive ribbon of each side seam also continues down the sleeve seam almost to the cuff with the electrically conductive ribbon of the side seam overlapping with this portion of the electrically conductive ribbon mounted within the sleeve seam. At the collar, the electrically conductive ribbons of both sleeve seams overlap each other. An output electrical connector is mounted within each side seam and respectively electrically connects with the ribbon of its side seam. It is to be understood that there are two separate electrical connectors. Each electrical connector is capable of being connected to an output electrical conducting wire with this wire to then be connected to an appropriate grounding connector on the exterior structure. A second version of the garment is as a smock with the smock being constructed in a similar manner with the leg sections being eliminated. A boot and a gaiter for a shoe could be constructed to include an electrical conducting ribbon.

BRIEF DESCRIPTION OF THE DRAWINGS

FIG. 1 shows a front view of the pant suit embodiment of static electricity dissipation garment of the present invention;

FIG. 2 is a cross-sectional view taken along line 2—2 of FIG. 1 showing the neck opening within the collar and also showing the hollow interior of the garment;

FIG. 3 is a cross-sectional view taken through one of the leg seams incorporated within the garment of the present invention taken along line 3—3 of FIG. 1;

FIG. 4 is a cross-sectional view taken through one of the sleeve seams incorporated within the garment of the present invention taken along line 4—4 of FIG. 1;

DETAILED DESCRIPTION OF THE PREFERRED EMBODIMENTS

Figure 5:
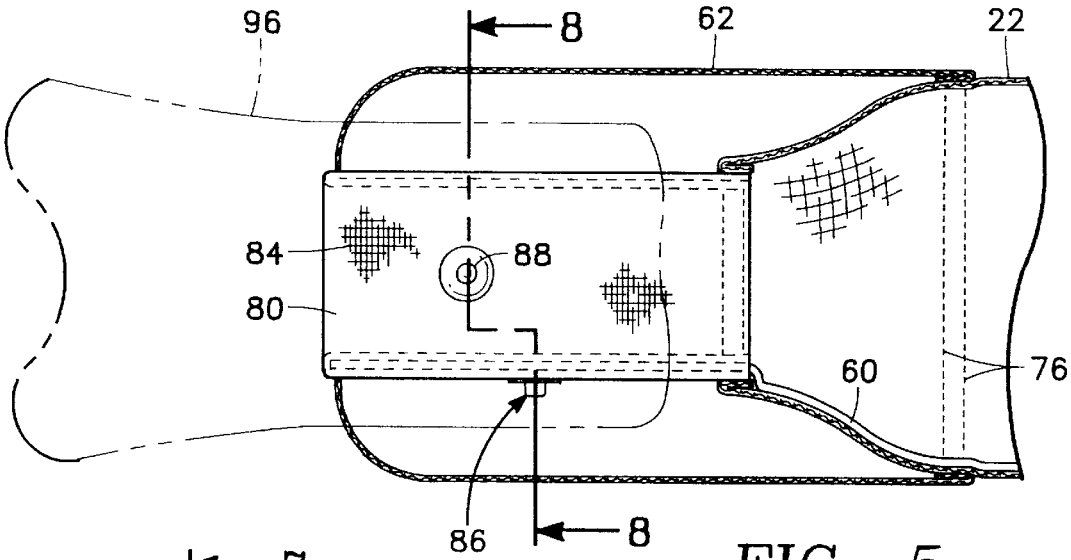
FIG. 5 is an enlarged view of one of the cuff areas which form the outer end of the sleeve of the garment of the present invention taken along line 5—5 of FIG. 1.
Figure 6:
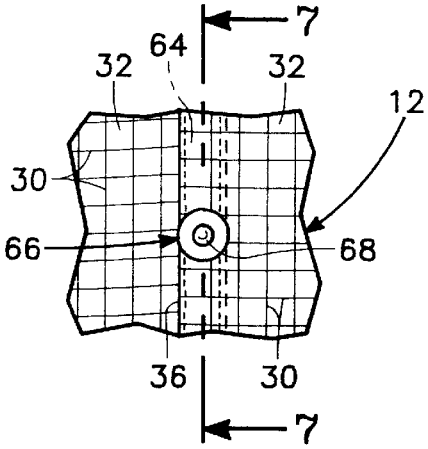
FIG. 6 is an enlarged view showing more clearly the electrical connector that is mounted in conjunction with one of the side seams of the garment taken along line 6—6 of FIG. 1.

Referring particularly to the drawings, there is shown in FIGS. 1 and 2 the pant suit embodiment of garment 10 constructed in accordance with this invention. The garment 10 is formed of a body 12 with this body 12 defining a pair of leg sections 14 and 16, a torso section 18 and a pair of sleeves 20 and 22. The leg sections 14 and 16 are connected at seam 24 to the lower end of the torso section 18. The leg sections 14 and 16 are joined together at seam 42. Sleeve 20 is connected by seam 26 to torso section 18. Sleeve 22 connects by seam 28 to torso section 18. The leg sections 14 and 16 are basically identical and of the same length and are located in juxtaposition. The sleeves 20 and 22 are also basically identical and are aligned and extend in opposite directions away from the torso section 18.

Typical material of construction of the body 12 of the garment would be a polyester type of fabric 32 within which are woven strands 30 of carbon. Typically the strands 30 are spaced about one-quarter of an inch apart and are located in a crisscross pattern forming a checkerboard appearance.

Leg section 14 is constructed of the fabric 32 which is formed into a tubular configuration and seamed together at side seam 34. The torso section 18 is also formed into a tubular configuration forming internal compartment 19 and is connected together at a seam that aligns with and forms part of the side seam 34 terminating at underarm area 40. In a similar manner, the leg section 16 is formed into the side seam 36 with this side seam 36 extending onto the torso section 18 terminating at underarm area 38. The front portion of the torso section 18 includes a zipper 23 which is to be manipulated by the user as needed to insert and remove the user's body relative to the garment 10.

The lower ends of each of the leg sections 14 and 16 are seamed together with the fabric 32 being overlapped upon itself. A similar type of seam arrangement is located in the seam 42 connecting together the leg sections 14 and 16 and also in seam 24 which connects leg sections 14 and 16 with torso section 18. It is to be understood that the lower end of each of the leg sections 14 and 16 will be open.

Sleeve 20 is also formed to be tubular with there being formed a sleeve seam 46. A similar sleeve seam 48 is formed within sleeve 22. Sleeve seam 46 connects with seam 26 which terminates at a collar 50. The collar 50 surrounds neck opening 51 of the garment 10.

A continuous length of electrically conductive ribbon 52 is sewn by threads 54 within overlapped sections of fabric 32 of side seam 34. It is important whenever possible to have the ribbon 52 to be continuous eliminating joints and eliminating possible non-electrically conducting areas. The ribbon 52 has a width of about one-fourth of an inch and is about the thickness of conventional fabric. The ribbon 52 is basically constructed of a polyester and nylon fabric with there being incorporated in the ribbon a mass of closely spaced apart carbon fibers. The result is the electrically conductive ribbon 52 comprises an electrical conductor. The electrically conductive ribbon 52 extends from the outer end of the leg section 14 along the entire length of the leg section 14 to the underarm area 40 of the torso section 18. From there, the electrically conductive ribbon 52 extends along seam 26 to the collar 50. Formed within the cuff 54 is the second length of ribbon 56 which is sewn by threads 58 in abutting contact with the electrically conductive ribbon 52. Therefore, the electrically conductive ribbons 52 and 56 overlap in the area of the upper torso of the garment 10. This overlapping helps insure that a positive electrical connection is continuously established between the ribbons 52 and 56. A similar ribbon 60 extends from the cuff 62 of the sleeve 22 with this ribbon 60 being conducted along the seam 28 to the collar 50. It can be seen in the area of the collar 50 that several inches of both ribbons 56 and 60 overlap. Within the area of the collar 50, these ribbons are to be tightly sewn together. It is to be understood that there is a ribbon 64 formed within the seam 36 with this ribbon 64 extending from the collar 50 the total length of the side seam 36.

It is to be understood that any static electricity accumulated on the body 12 of the garment 10 is conducted by the carbon fibers 30 to one of the ribbons 52, 56, 60 or 64. Mounted on the side seam 36 is an electrical connector 66. It is to be understood that a similar electrical connector (not shown) is mounted in conjunction with the side seam 34. The electrical connector 66 comprises a female member 68 and a male member 70. The male member 70 is inserted within the female member 68 with sections of the ribbons 60 or 64 as well as layers of the fabric 32 being tightly bound there between. A positive electrical connection is subsequently formed with the side seam 36 and also a similar electrical connection is formed with the side seam 34. The electrical connector 66 is to be connected to socket 71 which is attached to an electrically conductive wire 72 which is shown being connected with the electrical connector mounted in conjunction with the side seam 34. It is to be understood that there may be utilized only one electrical conductive wire 72 which is connected only with one of the electrical connectors 66 but not both at the same time. The electrically conductive wires 72 include a plug 74 which is to be connected with an appropriate female socket (not shown) of an exterior grounding connector. The accumulated static electricity from a garment is then discharged through the electrically conductive wire or wires 72 to the appropriate electrical ground.

It is to be noted that the entire garment 10 is constructed in a manner that facilitates normal cleaning without impacting its effectiveness in the minimizing of static electricity over an extended period of time. Also, garment 10 is to include an elongated slit (not shown) within the torso section 18 which permits the user to enter and remove himself or herself from the garment 10. The slit is to be closable by buttons or the zipper 23.

Figure 8:
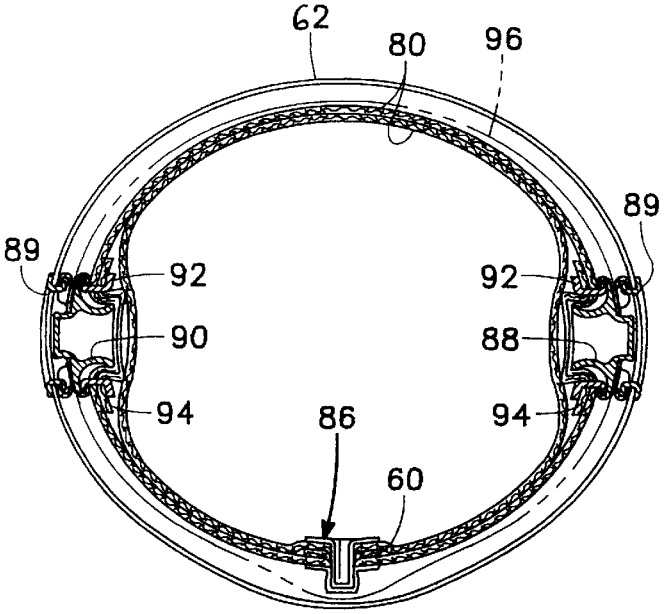
FIG. 8 is a cross-sectional view through the cuff of the garment taken along line 8—8 of FIG. 5.

Referring particularly to FIGS. 5 and 8 of the drawings, there is a fabric cuff 62 that is sewn at seam 76 to the sleeve 22. It is to be understood that the fabric cuff 54 is sewn also at seam 78 to the sleeve 20. The cuffs 62 and 54 are essentially identical. The sleeve 22 terminates in a fabric tubular section 80. The sleeve 20 terminates in a similar manner in a fabric tubular section 82. Each of the fabric tubular sections 80 and 82 have sewn therein a mass of carbon fibers 84. Ribbon 60 is sewn in conjunction with the tubular section 80. An electrical connector 86, which is basically identical to the electrical connector 66, is mounted in conjunction with overlapped sections of tubular section 80 with the ribbon 60 being bound there between. An appropriate electrical connection is now provided with the tubular section 80. It is to be understood that the tubular section 80 will expand to permit passage therethrough of the user's hand with the tubular section 80 to rest on the wrist of the user. The tubular section 80 is to be placed on the right wrist of the user with the tubular section 82 to be located on the left wrist of the user. Also mounted in conjunction with the tubular section 80 is a pair of snap fasteners 88 and 90. A pair of female fasteners 89 are mounted on the cuff 80 with each fastener 89 to connect with snap fasteners 88 and 90. These fasteners 88 and 90 are also to facilitate connection with a glove 96 that is to be worn by the user. The glove body is clamped between fasteners 89 and 88 and also between fasteners 89 and 90. It is to be understood that the wearing of a static dissipating glove is required. The snap fasteners 88 and 90 are each attached to tubular section 80 by means of a ring 92 which is snugly mounted about the rear portion of the snap fasteners 88 and 90. To prevent the ring 92 from cutting the tubular section 80, there is inserted a small insert piece 94 of fabric between ring 92 and tubular section 80.

Figure 9:
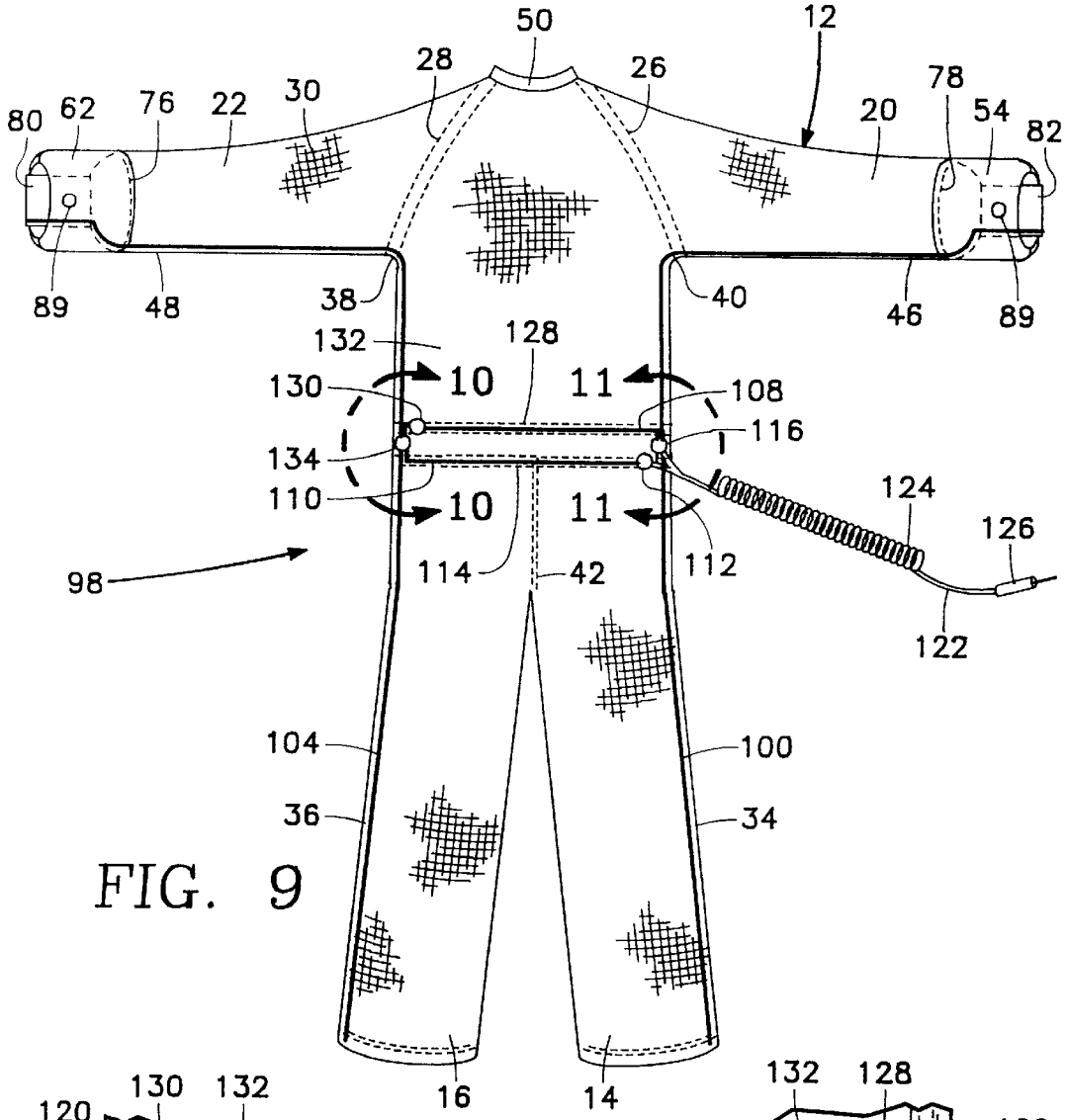
FIG. 9 is a back view of the second embodiment of pant suit static electricity dissipation garment of the present invention.
Figure 10:
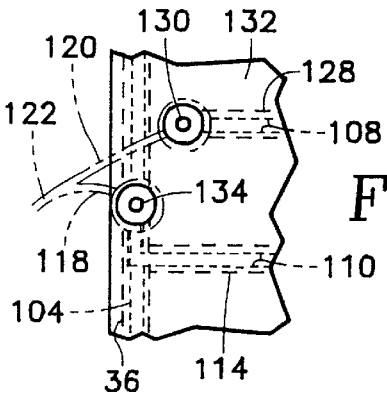
FIG. 10 is an enlarged view of the connector arrangement utilized in conjunction with the second embodiment of this invention taken along line 10—10 of FIG. 9.
Figure 11:
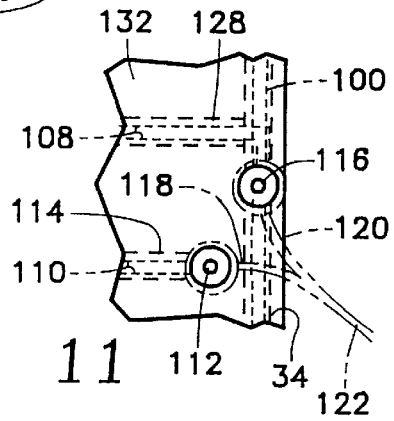
FIG. 11 is an enlarged view of further connector arrangement utilized in conjunction with the second embodiment of a static electricity dissipation garment of this invention taken along line 11—11 of FIG. 9.

Referring particularly to FIG. 9 of the drawings, there is shown the second embodiment 98 of pant suit garment 132 of this invention. Like numerals have been employed relative to the garment 10 to refer to like parts. The second embodiment 98 of the pant suit garment 132 of this invention has an electrically conductive ribbon 100 which is mounted within the side seam 34 with this ribbon 100 extending also along the sleeve seam 46. This electrically conductive ribbon 100 within the sleeve seam 46 terminates in a fabric tubular section 82.

Within the side seam 36, there is mounted an electrically conductive ribbon 104 which is conducted along the sleeve seam 48 and terminates in a fabric tubular section 80. Electrically connecting with the ribbon 100 is a transverse section 108 of ribbon. A similar transverse section 110 of electrically conductive ribbon is electrically connected with the electrically conductive ribbon 104. The outer end of the transverse section 108 is located directly adjacent the electrically conductive ribbon 104. In a similar manner, the outer end of the transverse section 110 is located directly adjacent the ribbon 100.

Mounted in conjunction with the outer end of transverse section 110 and electrically connecting with same is an electrical connector 112. The transverse section 110 is mounted in conjunction with a transverse seam 114. The electrical connector 112 is basically identical to the electrical connector 86. A similar electrical connector 116 is mounted in conjunction with the ribbon 100 at the seam 34. An electrically conductive wire 118 electrically connects with the connector 112 with a second wire 120 electrically connecting with the connector 116. The electrically conductive wires 118 and 120 are joined with conductor 122 which is to be wound into a coil 124. The conductor 122 terminates in a plug connector 126. The plug connector 126 is to be plugged into an electrical conducting socket which is not shown and has been previously discussed in relation to the plug connector 74. The coil 124 is to be expandable so as to permit the individual wearing the garment 98 to move within a confined area and can still remain electrically connected by the plug connector 126.

The transverse section 108 is mounted within a cross seam 128. The outer end of the transverse section 108 is electrically connected to a connector 130 that is mounted within the garment 132. A further connector 134 is mounted in conjunction with the ribbon 104 and located within the seam 36.

The user has the option of connecting the conductor 122 either to connectors 116 and 112 or to connectors 130 and 134. If the conductor 122 is connected to the connectors 112 and 116, the conductor 122 is connected to the left side of the users body. If the user has selected the conductor 122 to be connected to connectors 130 and 134, the conductor 122 is connected to the right side of the users body. With either connection, total extraction of the static electricity from the garment 132 is achieved.

Figure 12:
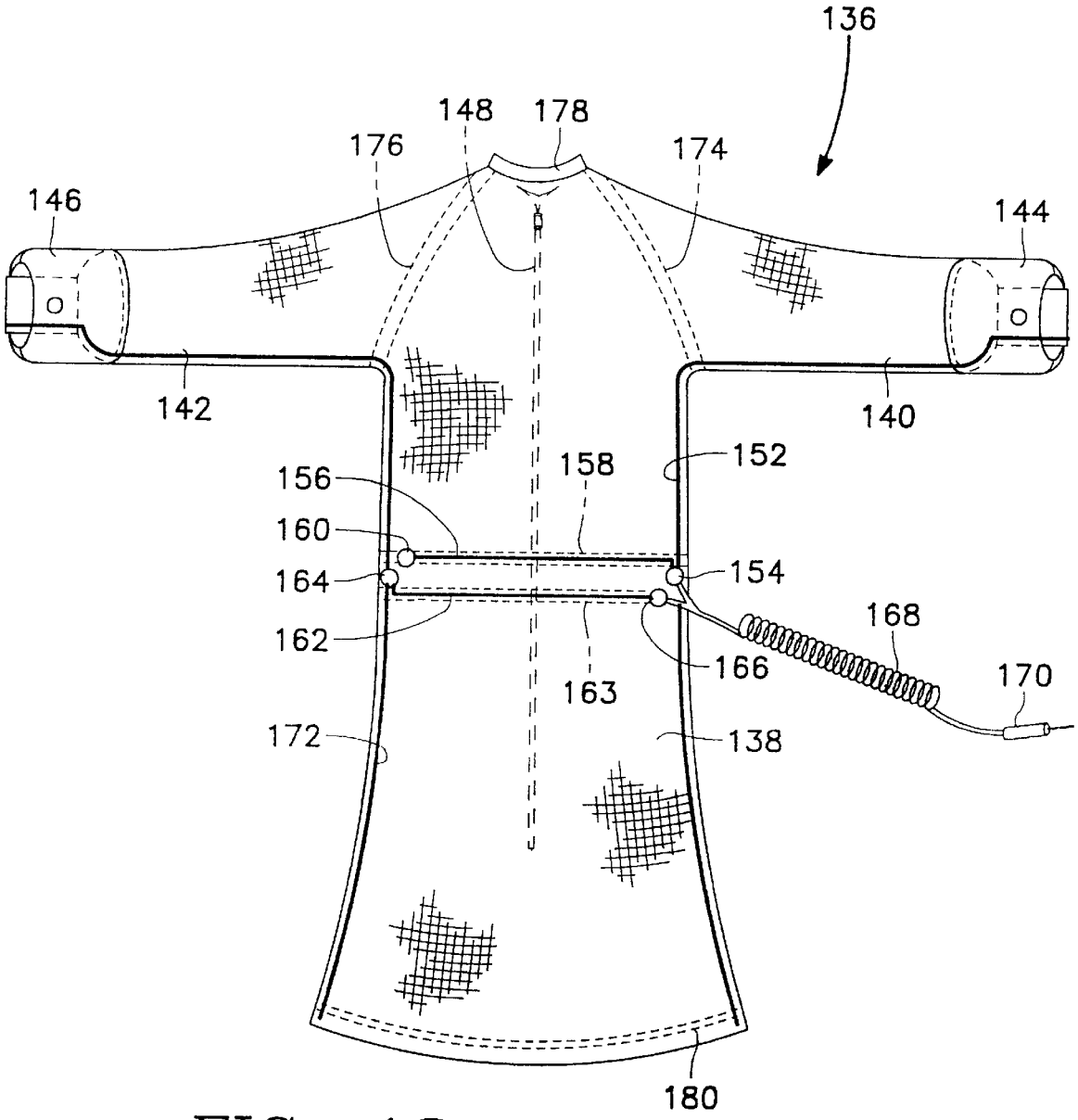
FIG. 12 is back view of a smock that is constructed in accordance with this invention to dissipate static electricity.

Referring particularly to FIG. 12 of the drawings, there is shown the smock version 136 of this invention. Within certain usage environment, the smock version would be preferred over the pant suit version. The smock version 136 is to be constructed of a fabric which is basically identical to the fabric 32. The smock version 136 defines a torso section 138 from which extends on opposite sides thereof sleeve sections 140 and 142. Sleeve section 140 terminates in a cuff 144. Sleeve section 142 terminates in a cuff 146. Torso section 138 includes a zipper 148 mounted within the front of the torso section 138. The upper end of the torso section 138 terminates in a collar 178 with the collar 178 to surround the user's neck. The zipper 148 is to be manually moved to open the smock 136 to permit entry and removal of the user's body from within the smock 136. It is to be noted that the smock version 136 does not have any leg sections which were in the embodiments of FIGS. 1–9.

An electrically conductive ribbon 152 extends from the cuff 144, down the sleeve 140 and down the entire length of the torso section 138. This electrically conductive ribbon 152 is connected to an electrical connector 154 which is basically identical in configuration to the electrical connector 116. This electrical connector 154 is also connected to a transverse section 156 of the electrically conductive ribbon 152. It is to be understood that the transverse section 156 is mounted within a fabric seam 158 with also the ribbon 152 being mounted within a seam which is not shown. The transverse section 156 is also connected to an electrical connector 160 which is essentially similar to the previously described electrical connector 130.

Located adjacent to the transverse section 156 but spaced slightly therefrom and also mounted on the back side of the smock 136 is a transverse ribbon section 162 which is mounted in a seam 163. One end of the transverse ribbon section 162 is connected to an electrical connector 164 with an opposite end of the transverse ribbon section 162 being connected to a connector 166. Both connectors 154 and 166 are to be connected to an electrical grounding wire 168 which in turn is to be plugged by plug connector 170 to a grounding socket which is not shown. The user of the smock 136 can either connect with connectors 154 and 166 or connect with connectors 160 and 164.

Connector 164 connects to an electrical conducting ribbon 172. The electrical conducting ribbon 172 extends from the cuff 146 down the sleeve 142 and then all along the torso section 138. Sleeve 142 is attached to the torso 138 by seam 176. Sleeve 140 is attached to the torso 138 by seam 174. The open bottom of the torso section 138 is closed by a seam 180 with the seam 180 being sewn within the fabric of the torso section 138.

Figure 7:
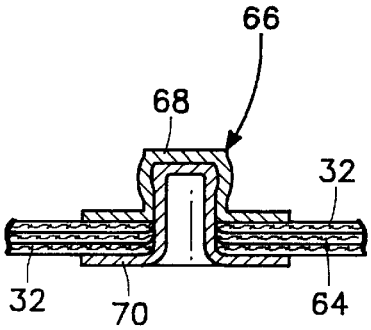
FIG. 7 is a cross-sectional view taken along line 7—7 of FIG. 6.
Figure 22:
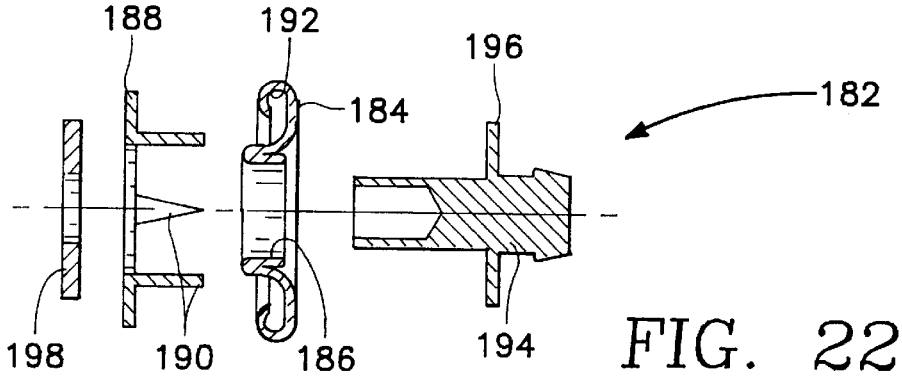
FIG. 22 is an exploded view of the configuration of connector that could be used instead of the connector shown in FIG. 7.
Figure 23:
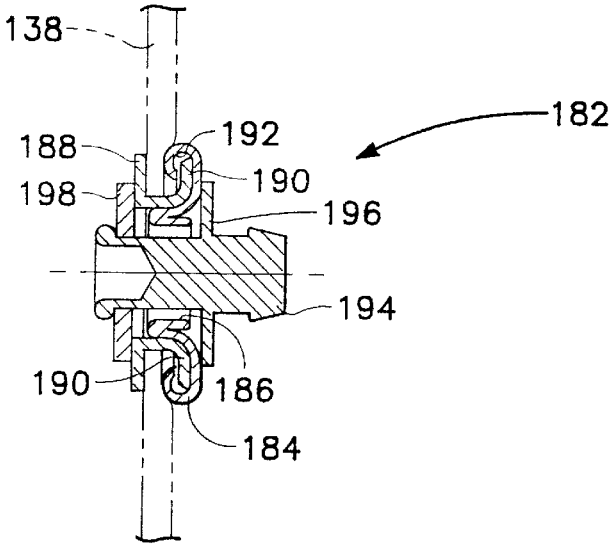
FIG. 23 is a view showing the connector of FIG. 22 in the completely assembled state.

The electrical connectors 154, 166 can take the form of the structure that is shown in FIG. 7 or can take the form that is shown in FIGS. 22 and 23. The electrical connector 182 in FIGS. 22 and 23 comprises a front disc 184 which has a center hole 186. Front disc 184 is to be placed against the exterior surface of the garment within which it is to be installed. The location is as shown in FIGS. 22 and 23 of the drawings. An impaling plate 188, which has a plurality of protruding spikes 190, is to be forced through the fabric with the impaling plate 188 abutting against the inside surface of the garment. In reference to FIG. 23, the garment is represented as torso section 138. The protruding spikes 190 are forced in conjunction with the front disc 184 resulting in the protruding spikes 190 bending and engaging with angular groove 192 of the front disc 184. This now forms a female connector since there is a similar opening which is not shown within the impaling plate 188 which aligns with center hole 186. This female type of connector can now be changed to a male type connector by the insertion of a male member 194 into the center hole 186 and through the hole formed in the impaling plate 188. The male member 194 has an annular flange 196 which is to abut against the front disc 184. The outer end of the male member 194 is to be deformed and be in a tight abutting contact with a washer 198 which abuts against the impaling plate 188. The protruding spikes 190 make an electrically positive contact with the ribbon, either ribbon 152 or ribbon 172, thereby achieving a positive electrical connection therewith. This type of positive electrical connection is necessary in order to achieve the maximum conductive ability of the electricity dissipation garment in the form of the smock 136.

Figure 13:
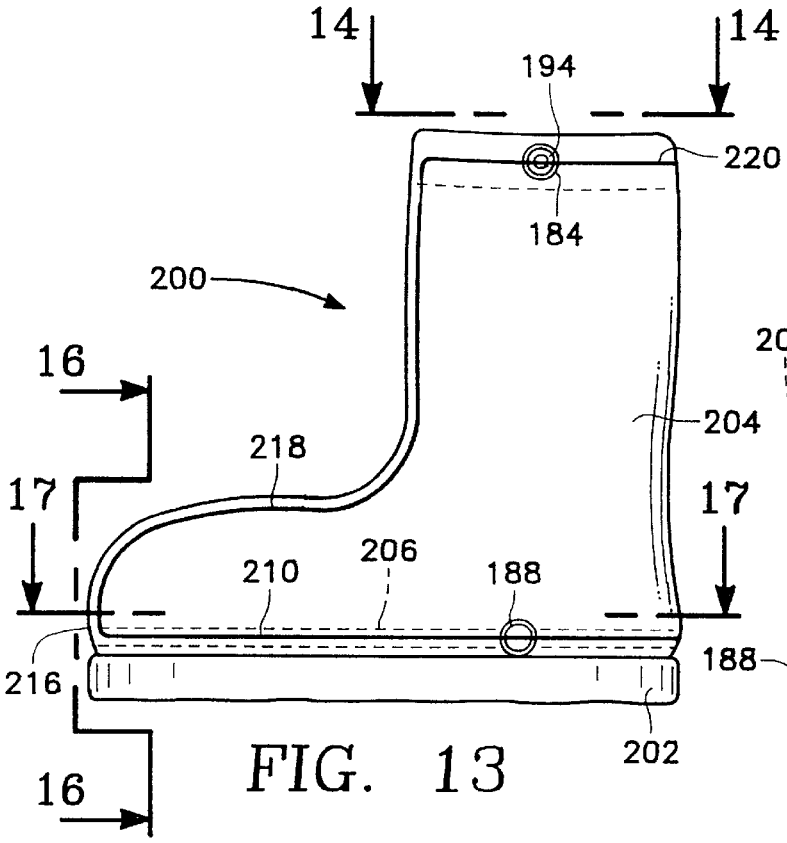
FIG. 13 is a side elevational view of a boot that is constructed to include the electrically conductive ribbon included within this invention that dissipates static electricity.
Figure 16:
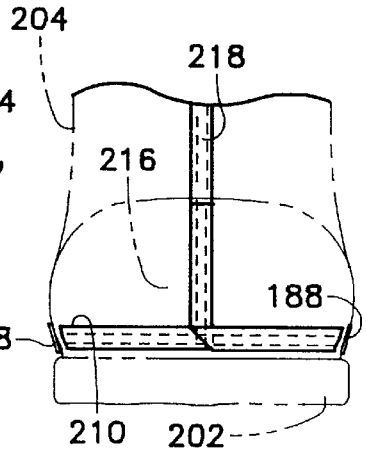
FIG. 16 is a front view of the boot of FIG. 13 showing the boot in phantom and depicting the technique for folding of the ribbon in order to change the laying direction of the ribbon by ninety degrees.
Figure 14:
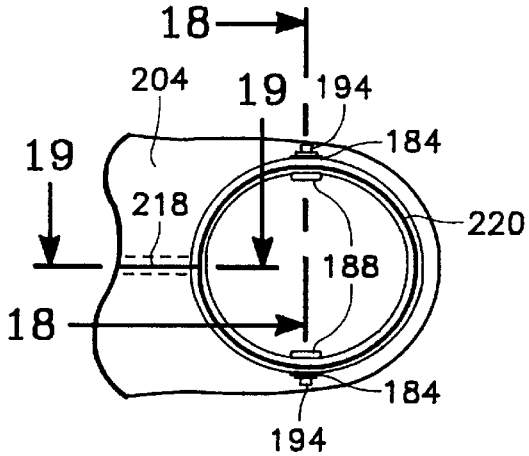
FIG. 14 is a top plan view of boot taken along line 14—14 of FIG. 13.
Figure 15:
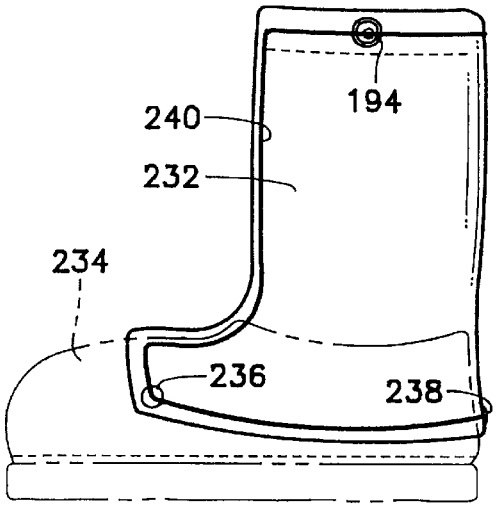
FIG. 15 is a side elevational view of a gaiter that is to be mounted on a conventional shoe with the gaiter being constructed with the features of the present invention in order to dissipate static electricity.
Figure 17:
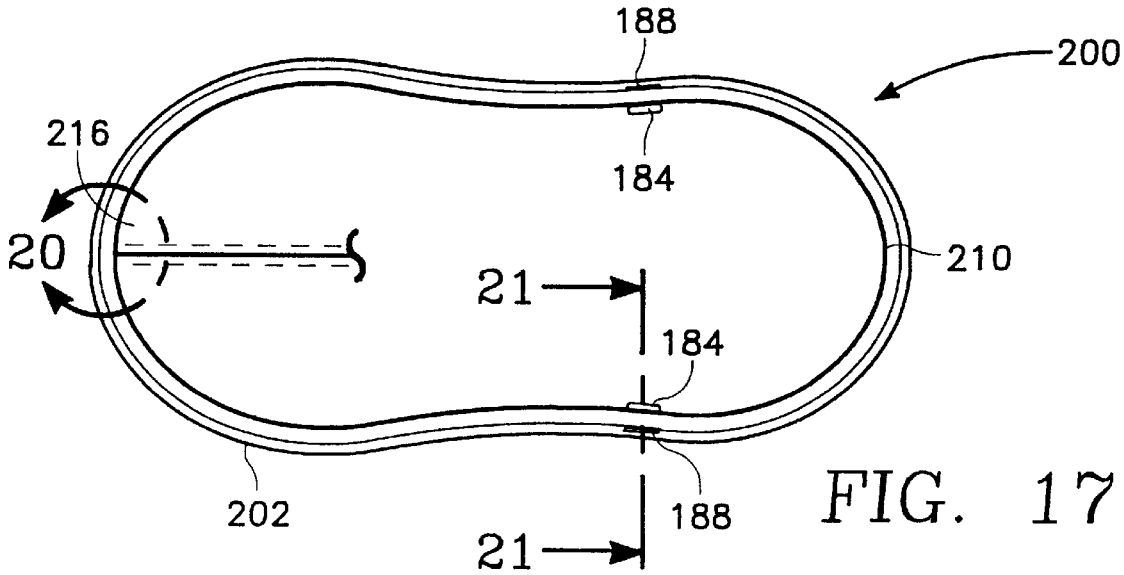
FIG. 17 is a cross-sectional view through the boot showing in more detail the sole of the boot taken along line 17—17 of FIG. 13.
Figure 18:
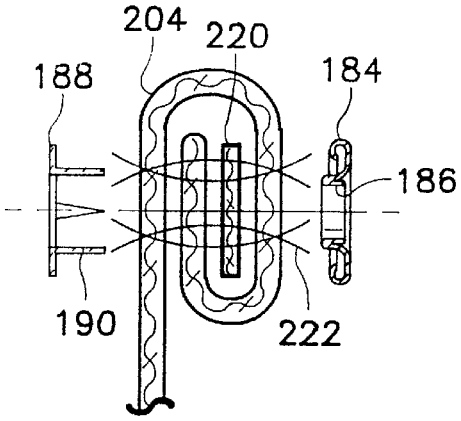
FIG. 18 is a cross-sectional view through the snap arrangement utilized in conjunction with the upper area of the boot taken along line 18—18 of FIG. 14.
Figure 19:
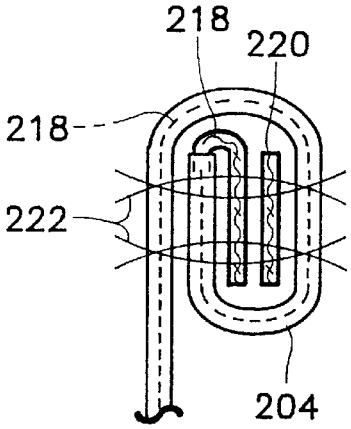
FIG. 19 is a cross-sectional view at the upper or ankle portion of the boot where the electrical conductive ribbon changes from a horizontal direction to a vertical direction taken along line 19—19 of FIG. 14.
Figure 20:
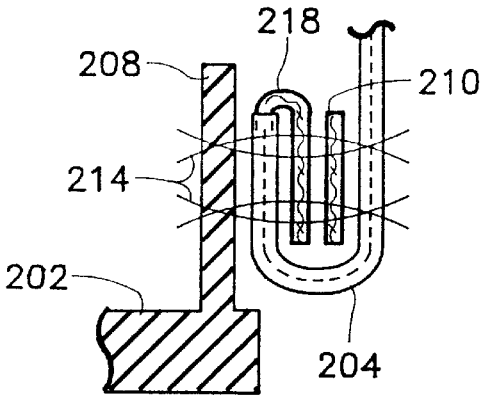
FIG. 20 is a cross-sectional view of the front or toe portion of the boot where the electrical conductive ribbon changes from a vertical direction to a horizontal direction taken along line 20—20 of FIG. 17.
Figure 21:
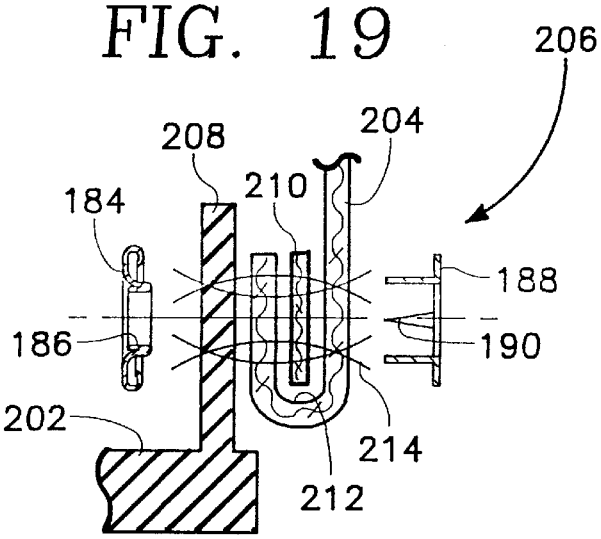
FIG. 21 is a cross-sectional view through the configuration of connector that is utilized on the side of the sole of the boot taken along line 21—21 of FIG. 17.

Referring particularly to FIG. 13, there is shown a boot 200 which has a sole 202 and an upper 204. The upper 204 is to be fixedly secured to the sole 202 by means of a sewn seam 206. The sole 202 is to be constructed in a conventional manner to be electrically conductive. The sole 202 includes an enclosing thin wall 208. The upper 204 is folded into a U-shape configuration and the electrically conductive ribbon 210 is located in the gap area 212 formed by the upper 204. The seam 206 is then formed by actually sewing, with threads 214, the upper 204 and the ribbon 210 to the thin wall 208. A positive electrical connection is then achieved between the thin wall 208 and the ribbon 210 by the female version of electrical connector composed of impaling plate 188, protruding spikes 190 and front disc 184. It is to be noted that in referring to FIG. 17 there is one of the connectors shown in FIG. 21 on each lateral edge of the sole 202.

Ribbon 210 is wound completely around the thin wall 208 and overlaps in the front or toe section 216 of the boot 200. Within the toe section 216, the ribbon 210 is then twisted at a double forty-five degree angle to form a vertical section 218 of the ribbon 210. This vertical section 218 is sewn within a seam. This vertical section traverses the entire height of the boot 200 and directly adjacent at the foot entry opening of the boot 200, the ribbon 218 forms again a double forty-five degree angle and then forms an enclosing horizontal section 220. This enclosing horizontal section 220 wraps completely around foot entry opening of the boot 200 and is again sewn by seam 222 to the upper 204. It is to be noted that the end of the horizontal section 220 overlaps with a portion of the vertical section 218. Connecting with the horizontal section 220 are again a pair of connectors like that shown in FIG. 23 with there being one connector on each side of the boot 200. These connectors form a positive electrical connection with the horizontal section 220.

Figure 24:
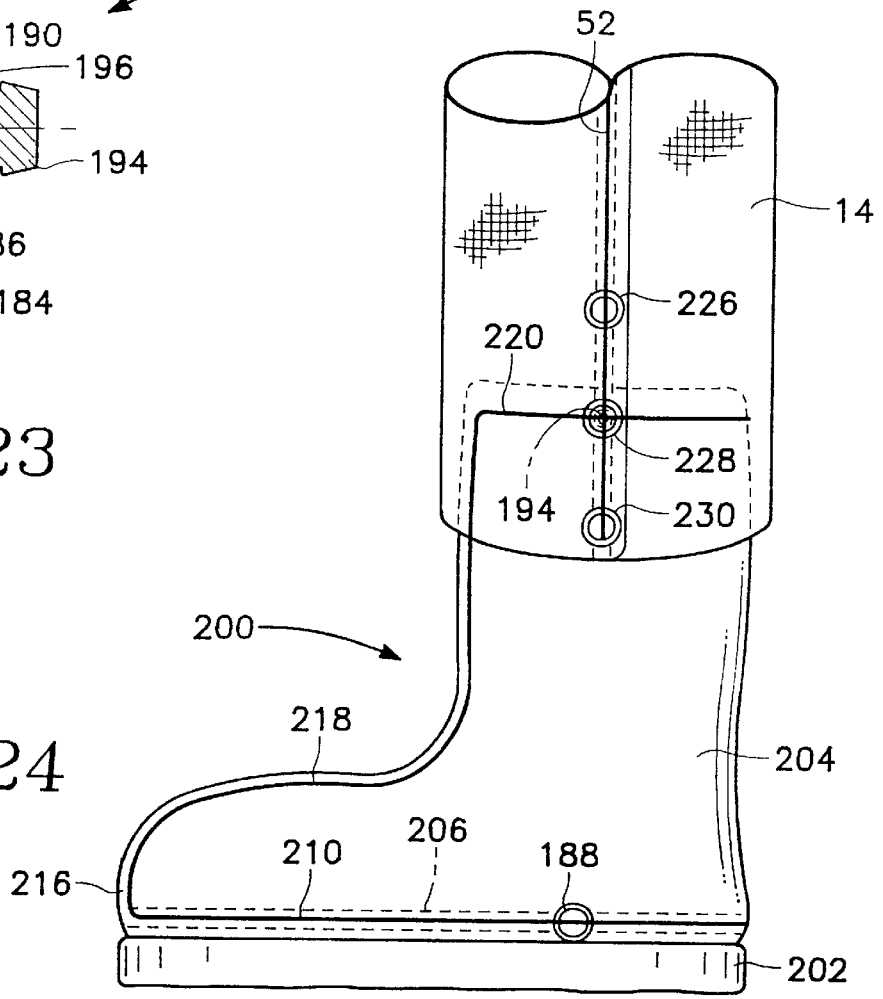
FIG. 24 is an isometric view of a portion of a pant leg of the pants suit garment shown in FIGS. 1 and 9 of the drawings.

The male member 194 of the connectors that connect with the ribbon 220 are to be connectable with female connectors 226, 228 or 230 which are mounted on each of the leg sections 14 and 16. The leg section 14 is shown in FIG. 24. Therefore by connecting one of the female connectors 226, 228 and 230 with the male member 194, a positive electrical conducting path is provided between the horizontal section 220 of the electrically conductive ribbon of the boot 200 and the electrically conductive ribbon 52 which is mounted within the leg section 14. Therefore, any static electricity which is picked up by the boot 200 is then dischargeable through the grounding wire 72. The reason for the three different connectors 226, 228 and 230 is to provide a degree of adjustment to accommodate to different heights of individuals that may be wearing the pant suit type of garment 10.

It is possible that instead of using a specially constructed electrically conductive boot 200, there could be installed a gaiter 232 over a conventional shoe 234. The gaiter 232 is to be secured by connectors 236 and 238 to the shoe 234. Normally the type of connector for 236 and 238 would be what is deemed to be the female type of connector which is composed of the front disc 184 and the impaling plate 188. The gaiter 232 is to include an electrically conductive ribbon 240 which is connected by electrical connectors, such as shown in FIG. 23, which in turn are to be connected with a female connector such as 226, 228 or 230.

What is claimed is:

1. A static electricity dissipation garment comprising:

a torso section and two sleeves which are in alignment with each other and which extend from said torso section each in an opposite direction, said torso section having a collar enclosing a neck opening at its upper end, each said sleeve terminating in a cuff at its outer end, said garment being constructed of a fabric which is impregnated throughout with electrically conductive threads;

said torso section having a pair of side seams and a pair of sleeve seams, each said sleeve seam extends between a said sleeve and said torso section, an electrically conductive ribbon mounted within each said side seam and each said sleeve seam, said electrically conductive ribbon extending substantially the entire length of each said side seam and each said sleeve seam; and an electrical connector connecting with one of said seams, said electrical connector adapted to connect with a grounding wire which extends from said garment and is adapted to connect with an exterior grounding connector.

2. A static electricity dissipation garment comprising:

a torso section and two sleeves which are in alignment with each other and which extend from said torso section each in an opposite direction, said torso section having a collar enclosing a neck opening at its upper end, each said sleeve terminating in a cuff at its outer end, said garment being constructed of a fabric which is impregnated throughout with electrically conductive threads;

said torso section having a pair of side seams and a pair of sleeve seams, each said sleeve seam extends between a said sleeve and said torso section, an electrically conductive ribbon mounted within each said side seam and each said sleeve seam, said electrically conductive ribbon extending substantially the entire length of each said side seam and each said sleeve seam; and a first transverse section of electrically conductive ribbon being mounted across said torso section connecting with one of said side seams, a second transverse section of electrically conductive ribbon extending across said torso section and connecting with the other of said side seams, a first pair of electrical connectors connecting between said first transverse section and one of said side seams, a second pair of electrical connectors connecting between said second transverse section and the other of said side seams, whereby the user is able to select a connection with either said first pair of electrical connectors or said second pair of electrical connectors with this connection to be with a grounding wire.

3. A static electricity dissipation garment comprising:

a body constructed of a fabric which is impregnated throughout with electrically conductive threads, said body having an elongated seam, said seam including an electrically conductive ribbon, an electrical connector connecting with said seam and electrically connecting with said ribbon, whereby said electrical connector is to connect with a grounding wire which is extends from said body which is to connect within an exterior grounding connector.

4. The static electricity dissipation garment as defined in claim 3 wherein:

said ribbon being mounted within said seam.

5. The static electricity dissipation garment as defined in claim 4 wherein:

said ribbon being secured within said seam by being sewn.

6. The static electricity dissipation garment as defined in claim 3 wherein:

said electrical connector connecting with said ribbon by impaling means.

7. A static electricity dissipation garment having:

a first sleeve and a second sleeve each constructed from material that is impregnated throughout with electrically conductive fibers;

a torso section constructed from said material that is impregnated throughout with said electrically conductive fibers;

a first sleeve seam connecting said first sleeve to said torso section;

a second sleeve seam connecting said second sleeve to said torso section;

a first electrically conductive ribbon mounted within said first sleeve seam to make electrical contact between said electrically conductive fibers of said first sleeve and said torso section; and a second electrically conductive ribbon mounted within said second sleeve seam to make electrical contact between said electrically conductive fibers of said second sleeve and said torso section.

8. The static electricity dissipation garment as defined in claim 7 further including:

a first torso seam; and a first torso electrically conductive ribbon mounted within said first torso seam to make electrical contact with said electrically conductive fibers of said torso section.

9. The static electricity dissipation garment as defined in claim 8 wherein:

said first torso electrically conductive ribbon is secured by being stitched to and in electrical contact with said first electrically conductive ribbon.

10. The static electricity dissipation garment as defined in claim 9 wherein:

said first torso electrically conductive ribbon and said first electrically conductive ribbon are integral.

11. The static electricity dissipation garment as defined in claim 8 further including:

a second torso seam; and a second torso electrically conductive ribbon mounted within said second torso seam to make electrical contact with said electrically conductive fibers of said torso section.

12. The static electricity dissipation garment as defined in claim 11 wherein:

said second torso electrically conductive ribbon is secured by being stitched to and in electrical contact with said second electrically conductive ribbon.

13. The static electricity dissipation garment as defined in claim 8 wherein said torso section includes a first pant leg and a second pant leg, said garment further including:

a second torso seam spaced from said first torso seam; and a second torso electrically conductive ribbon mounted within said second torso seam to make electrical contact with said electrically conductive fibers in said torso section, said first torso seam extending longitudinally along said first pant leg and said second torso seam extending longitudinally along said second pant leg.

14. The static electricity dissipation garment as defined in claim 13 wherein said garment further includes:

a first electrically conductive boot and a second electrically conductive boot, said first electrically conductive boot having a first releasable electrical connector, said second electrically conductive boot having a second releasable electrical connector; and said first torso seam includes a first electrical connector positioned for connection to said first releasable electrical connector, said second torso seam includes a second electrical connector positioned for connection to said second releasable electrical connector.

15. The static electricity dissipation garment as defined in claim 13 wherein said garment further includes:

a first electrically conductive gaiter and a second electrically conductive gaiter, said first electrically conductive gaiter having a first releasable electrical connector, said second electrically conductive gaiter having a second releasable electrical connector; and said first torso seam includes a first electrical connector positioned for connection with said first releasable electrical connector, said second torso seam includes a second electrical connector positioned for connection to said second releasable electrical connector.

16. The static electricity dissipation garment as defined in claim 7 wherein said garment further includes:

a first electrically conductive glove and a second electrically conductive glove, said first electrically conductive glove having a first releasable electrical connector, said second electrically conductive glove having a second releasable electrical connector; and said first sleeve seam includes a first electrical connector positioned for connection with said first releasable electrical connector, said second sleeve seam includes a second electrical connector positioned for connection to said second releasable electrical connector.

17. The static electricity dissipation garment as defined in claim 7 wherein said garment further includes:

a collar;

a first torso seam;

a first torso electrically conductive ribbon secured by being stitched within said first torso seam to make electrical contact with said electrically conductive fibers of said torso section, said first torso electrically conductive ribbon extending adjacent said first electrically conductive ribbon in a portion of said first sleeve seam and to said collar;

a second torso seam; and a second torso electrically conductive ribbon secured by being stitched within said first torso seam to make electrical contact with said electrically conductive fibers of said torso section, said second torso electrically conductive ribbon extending adjacent said second electrically conductive ribbon in a portion of said second sleeve seam and to said collar.

18. The static electricity dissipation garment as defined in claim 17 wherein said garment further includes:

a first cross seam in electrical connection with said first torso seam, said first cross seam extending from said first torso seam to a position directly adjacent but electrically spaced from said second torso seam;

a second cross seam connecting with said second torso seam, said second cross seam extending from said second torso seam to a position directly adjacent said first torso seam but electrically spaced therefrom;

a first cross seam electrically conductive ribbon stitched within said first cross seam and being in electrical connection with said first torso electrical conductive ribbon;

a second cross seam electrically conductive ribbon stitched within said second cross seam and being in connection with said second torso electrically conductive ribbon; and an electrical ground connection electrically connected to said garment, said electrical ground connection connecting with both said first cross seam electrically conductive ribbon and said second cross seam electrically conductive ribbon.

19. The static electricity dissipation garment as defined in claim 7 wherein said first electrically conductive ribbon includes:

a plurality of electrically conductive fibers, the number of said electrically conductive fibers per unit area of said electrically conductive ribbon being greater than said material that is impregnated throughout with said electrically conductive fibers.

20. A seam for static electricity dissipation garment that is constructed from at least a first sheet and a second sheet of electrically conductive sheet material, said seam including:

a first outer edge portion of said first sheet of said electrically conductive sheet material;

a first inner edge portion of said first sheet of said electrically conductive sheet material;

a second outer edge portion of said second sheet of said electrically conductive sheet material;

a second inner edge portion of said second sheet of said electrically conductive sheet material;

conductive ribbon means, said conductive ribbon means and said edge portions being formed in a stack with said first inner edge portion being in contact with said second outer edge portion and said second outer edge portion being in contact with said conductive ribbon means, said conductive ribbon means being in contact with said first outer edge portion and said first outer edge portion being in contact with said second inner edge portion; and stitching extending through said stack to securely retain said edge portions and said conductive ribbon means in electrical connection.

21. The seam as defined in claim 20 wherein said conductive ribbon means include:

a first conductive ribbon mounted in connection with said second outer edge portion; and a second conductive ribbon mounted in connection with said first outer edge portion and said first conductive ribbon.

* * * * *